US005836555A

United States Patent [19]

Ellsworth et al.

[11] Patent Number: 5,836,555

[45] Date of Patent: Nov. 17, 1998

[54] INDUSTRIAL CHAIR

[75] Inventors: Thomas Lee Ellsworth, Shorewood; Alwin J. Stahel; Peter Robert Fervoy, both of St. Paul, all of Minn.

[73] Assignee: Safco Products Company, New Hope, Minn.

[21] Appl. No.: 664,243

[22] Filed: Jun. 7, 1996

[51] Int. Cl.[6] ..... F16M 11/00

[52] U.S. Cl. ..... 248/161; 248/157; 297/344.18; 297/423.1

[58] Field of Search ..... 248/161, 407, 248/411, 412, 157, 408, 414, 903; 297/344.18, 423.1

[56] References Cited

U.S. PATENT DOCUMENTS

| | | | |
|---|---|---|---|
| 1,933,096 | 10/1933 | Child | 297/423.1 |
| 2,939,514 | 6/1960 | Buettner et al. | 248/408 |
| 3,059,888 | 10/1962 | Lie | 248/161 |
| 3,572,869 | 3/1971 | Studinski et al. . | |
| 3,598,351 | 8/1971 | Schreyer . | |
| 4,636,004 | 1/1987 | Neumuller . | |
| 5,046,652 | 9/1991 | Shanok et al. | 248/903 X |
| 5,228,748 | 7/1993 | Neumuller . | |
| 5,328,240 | 7/1994 | Neumuller . | |
| 5,332,188 | 7/1994 | Davis et al. | 248/903 X |
| 5,340,194 | 8/1994 | Neumuller . | |
| 5,536,068 | 7/1996 | Valentor et al. | 297/344.18 |

FOREIGN PATENT DOCUMENTS

| | | | |
|---|---|---|---|
| 217060 | 1/1957 | Australia | 153/194 |

OTHER PUBLICATIONS

American Nat. Stand. for Human Factors Engin. of Visual Display Terminal Workstations (published by The Human Factors Society, Inc., 1988.

*Primary Examiner*—Ramon O. Ramirez
*Attorney, Agent, or Firm*—Patterson & Keough, P.A.

[57] ABSTRACT

An improved industrial chair having a mechanism for adjusting the position of a support column in relation to a fixed platform, such as a chair base portion. The chair comprises a support column having an exterior surface with a plurality of engaging surfaces arranged along the length of the column for selectively engaging portions of a coupling. The coupling is shaped for selectively engaging the support column and positioning the support column relative to the fixed platform. The coupling has an inner surface shaped for contacting the support column engaging surfaces in a substantially matched shape friction fit, and the coupling further has an adjustable circumference structure for permitting selection between locking engagement and relative movement between the support column and the coupling. The chair further has structure suitable for operably retaining the coupling in fixed relation to the support platform.

20 Claims, 16 Drawing Sheets

INDUSTRIAL CHAIR

FIELD OF INVENTION

The invention relates to an adjustable chair useful in industrial settings to accommodate the widely varying sizes and weights of multiple users.

BACKGROUND OF INVENTION

Numerous designs exist for chairs, including adjustable chairs, for use in various settings. However, chairs which are particularly useful in multiple user environments have traditionally been unsuitable. Aspects of this unsuitability relate to comfort, stability, durability, and weight. Typically, one user will find different comfort from another user of the same chair. In similar manner, the strength and morphology of a first user will differ significantly from a second user, thereby affecting the relative ability of each user to adjust and/or move a chair to suit the particular user's needs. In order to overcome these multiple challenges to finding a suitable chair, a typical response has been to accommodate the largest and heaviest user at the expense of ergonomics, particularly for a smaller user.

What is needed is a chair suitable for high use, multi-user settings which optimizes the various features of comfort, durability, adjustability, and ergonomics.

SUMMARY OF THE INVENTION

The invention relates to a mechanism for adjusting the position of a support column in relation to a fixed platform. The mechanism comprises a support column having an exterior surface with a plurality of engaging means arranged along the length of the column for selectively engaging portions of a coupling. The coupling is used for selectively engaging the support column and positioning the support column relative to a fixed platform. The coupling has an inner surface shaped for contacting the support column engaging means in a substantially matched shape friction fit. The coupling further has adjustable circumference means for permitting selection between locking engagement and relative movement between the support column and the coupling. A retaining means is provided for operably retaining the coupling in fixed relation to the support platform.

The invention also comprises a release and carrying mechanism for a chair having at least one vertical support column for a chair seat and a base against which the support column contacts. The mechanism comprises a collar attachment for connection to the base, the collar attachment having a first portion for attachment to the base and an internally tapered second portion for selective contact with a support column coupling. The support column coupling extends radially from the support column. The coupling comprises a base portion with an opposing tapered portion designed for contact with the collar attachment second portion during release and carrying of the chair. The taper of the tapered second portion of the collar attachment is substantially matched to the taper of the tapered portion of the coupling so that when the coupling is surrounded by the collar attachment then a first force may be applied to move the coupling and cause static contact between the tapered portion of the coupling and the collar attachment without removing the coupling from within the collar attachment. Alternately, a second force greater than the first force may be applied to move the coupling relative to the collar attachment so that the tapered portions are in dynamic contact and the coupling is removed from within the collar attachment.

The invention further comprises a combination support step and footrest for a chair having a base with a plurality of angled base supporting members. The footrest comprises an elongate outer wall structure having a length generally corresponding to the distance between adjacent angled base supporting members of the chair base and reinforcing means for providing increased strength. A pair of end wall portions are provided having surfaces shaped for conformal attachment to outer surfaces of adjacent angled base supporting members. Means for attaching each combination support step and footrest to various locations of any of the angled base supporting members is also provided.

DETAILED DESCRIPTION OF THE INVENTION

Figure 1:
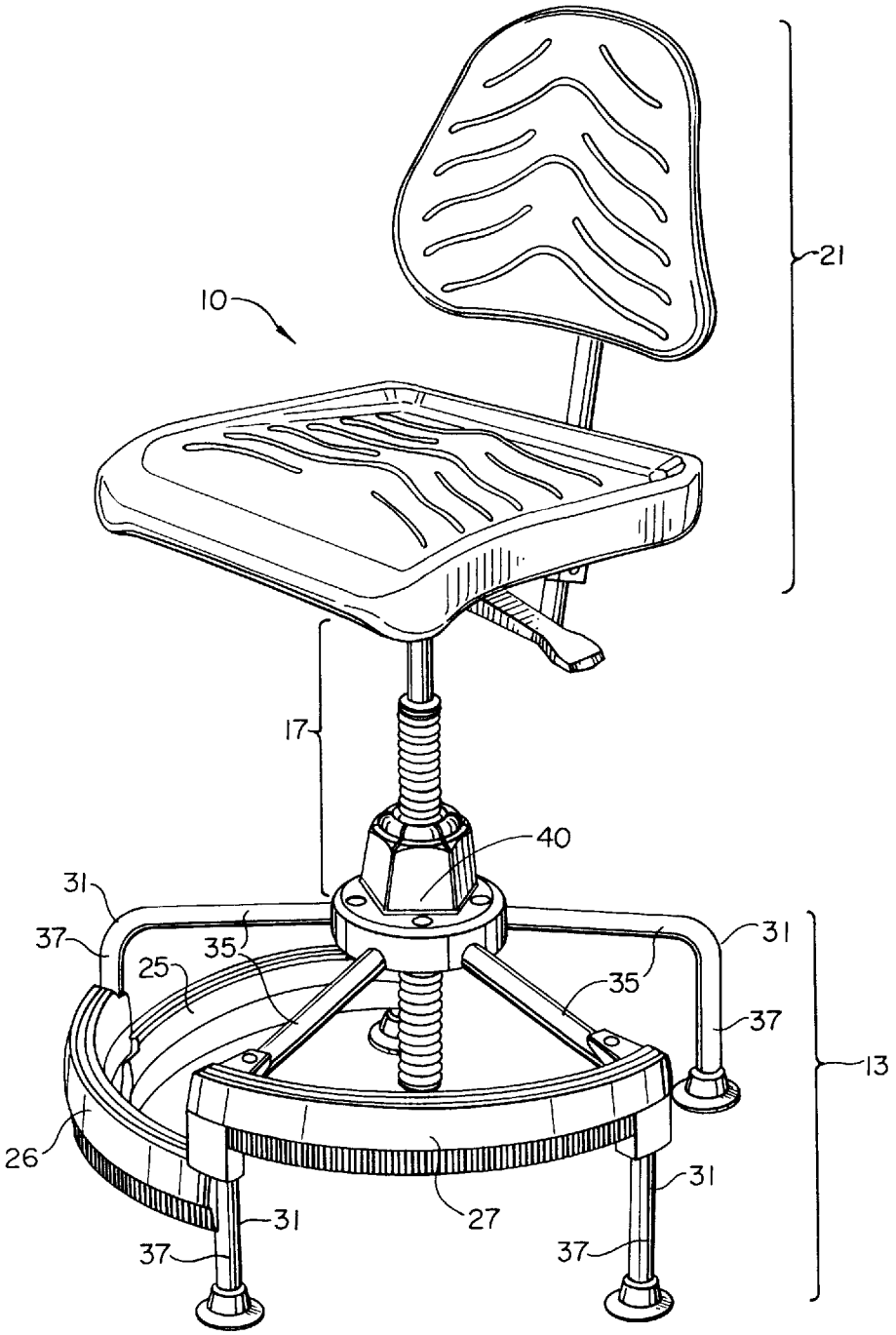
FIG. 1 is a perspective view of a chair of the present invention.

FIG. 1 illustrates a chair 10 having a base portion 13, a height adjustment portion 17, and a seating and backrest portion 21. Chair 10 is designed for use in industrial or other applications in which there is a variety of users of the chair. For example, in an industrial setting, different shifts of workers may have different weight or height requirements for a chair. In the context of this description, an industrial setting includes, for example, assembly or processing facilities, laboratory or engineering facilities, visual display terminal workstations, and other types of uses in which the chair, as described, would be useful. Such a chair must comfortably accommodate many different users, and be sturdy enough to sustain long use in any such demanding environment. Such a chair will experience many adjustments during its life cycle. Therefore, a chair meeting such demand must optimize comfort, utility, ease of adjustment and movement, and durability. Chair 10 possesses all of these characteristics, and uses structures to achieve such characteristics in a manner not previously taught or used.

Base portion 13 of chair 10 employs optional and adjustable footrests such as footrests 25, 26, and 27, as shown in FIG. 1. Footrests 25–27 are attachable to chair legs 31 at various positions. Chair legs 31 are shown in this embodiment with a substantially horizontal portion 35 and a substantially vertical portion 37, although various configurations and shapes of chair legs 31 are contemplated within the scope of this invention. In the embodiment of FIG. 1, chair legs 31 are integrally connected at axial portion 40 of chair 10.

Figure 2:
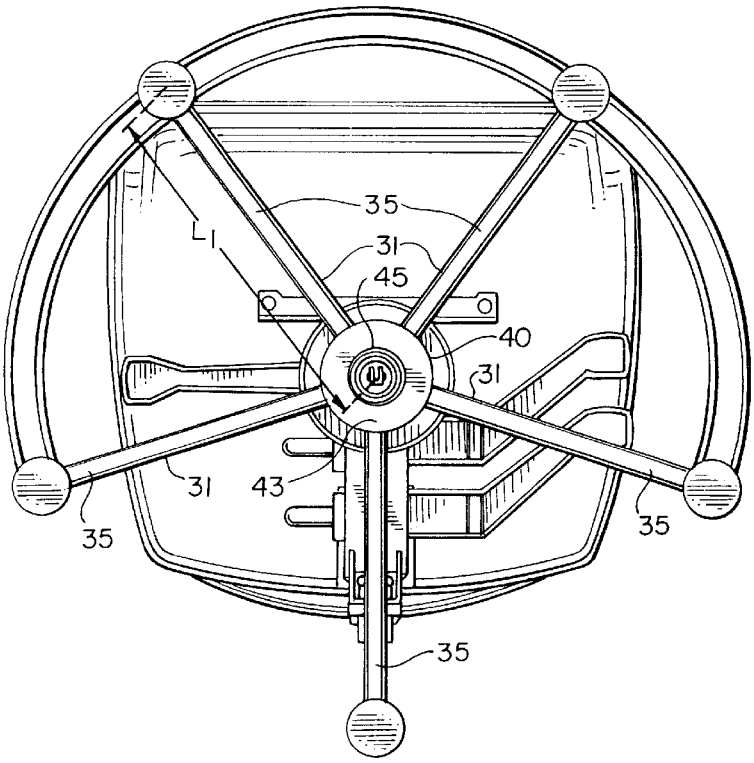
FIG. 2 is a bottom plan view of the chair.

Referring to FIG. 2, which is a bottom plan view of chair 10, axial portion 40 is shown comprising reinforcing member 43 which is durably connected to legs 31. It is recognized that alternate reinforcing means between legs 31 may be employed, depending upon the configuration of the legs. However, in this embodiment, reinforcing member 43 comprises a substantially planar member having a circular shape in plan view. Reinforcing member is preferably welded to legs 31, recognizing that different welding or bonding techniques are appropriate for the choice of leg and reinforcing member material utilized. In the embodiment shown in FIG. 2, reinforcing member 43 includes a portion welded to a lower side of horizontal portions 35 of legs 31 and a portion welded to an upper side of horizontal portions 35. Various connections which are different from those shown may be utilized provided that a stable base portion for chair 10 results. As shown in FIG. 2, reinforcing member 43 defines a central aperture 45, for cooperation with height adjustment portion 17 components, discussed later below.

Figure 3:
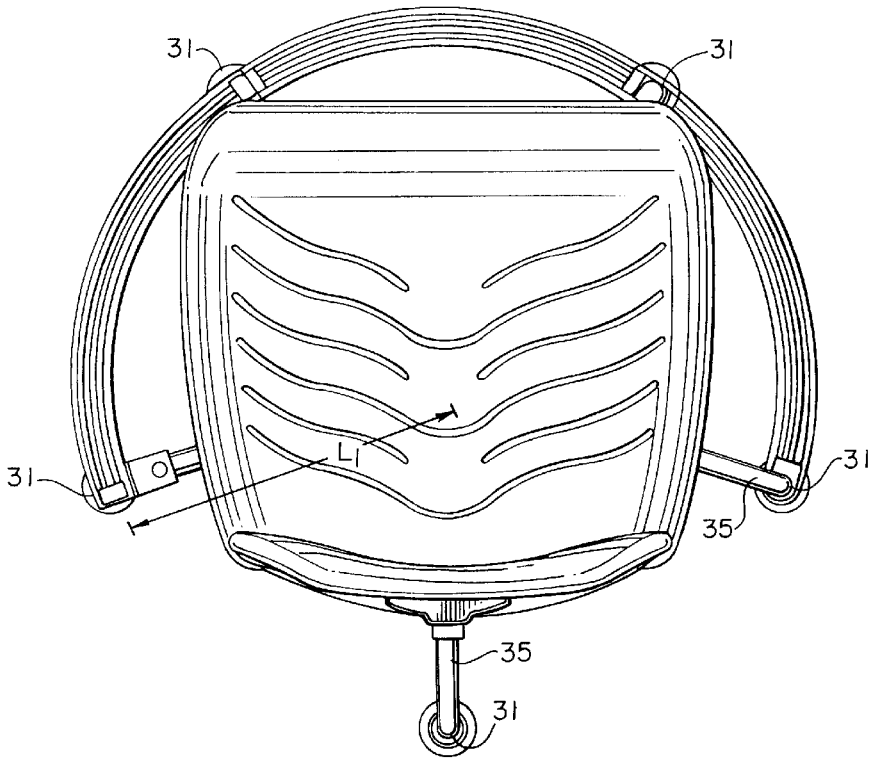
FIG. 3 is a top plan view of the chair.

A fundamental characteristic of chair 10 is stability; essentially regardless of the height to which the chair is adjusted, and essentially regardless of the size of a user. Accordingly, the radius of the base is preferably greater than the radius of any portion of the seating and backrest portion 21. The radius of the base, in this embodiment of legs 31, is substantially defined by the length $L_1$ of horizontal portion 35. As shown in FIGS. 2 and 3, the latter being a top plan view of chair 10, length $L_1$ allows base portion to be wider than seating and backrest portion 21.

Chair 10 further comprises adjustable footrests 25, 26, and 27. As shown in FIG. 1 and more particularly in FIGS. 4–10, a first embodiment footrest is disclosed. In this embodiment, the footrest is similar to that shown in FIG. 1 as footrests 25 and 26, but may be referred to for simplicity as either footrest 25 or 26. First, referring again to FIGS. 1–3, the particular configuration of footrests associated with chair 10 is one in which each footrest comprises an arc curve between two radius-like chair legs 31. As shown, the arc curves are formed substantially beyond the radial extension of any portion of the seat and backrest portion 21. This further enhances the stability of the chair and of the user sitting in the chair due to each of the user's feet being placed at a desired location on one of the footrests but in a position extending substantially outwardly from the remainder of their torso and legs. This configuration minimizes the risk of a user tipping when using chair 10. It is recognized, however, that certain less preferred embodiments may entail portions of the seat or backrest extending beyond the radius of extension of the chair leg, provided that the chair still maintains acceptable stability characteristics. Also, it is contemplated that other shapes of footrest may be used in conjunction with other novel elements of this chair invention.

Figure 4:
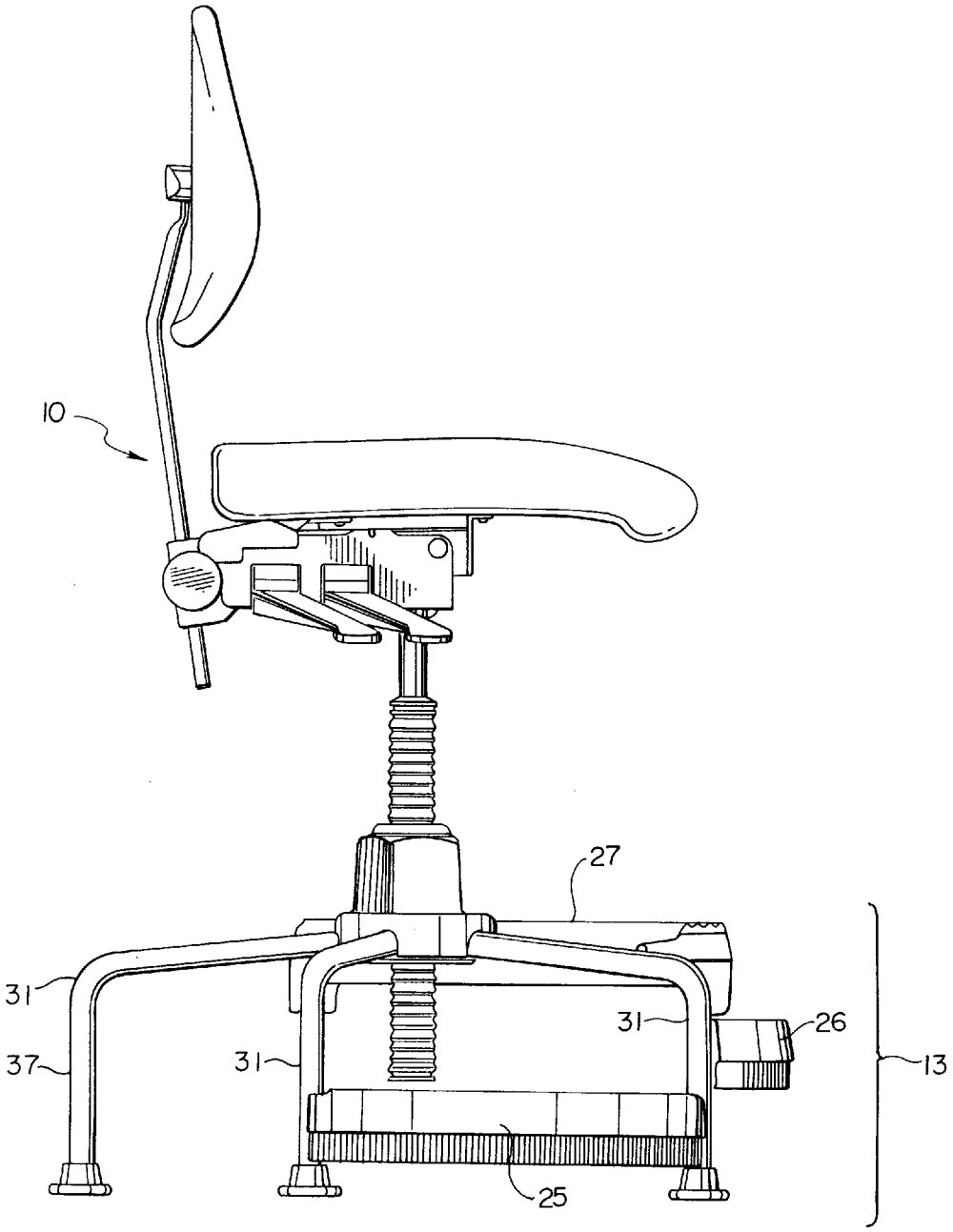
FIG. 4 is a side elevation view of the chair illustrating the various footrests.
Figure 5:
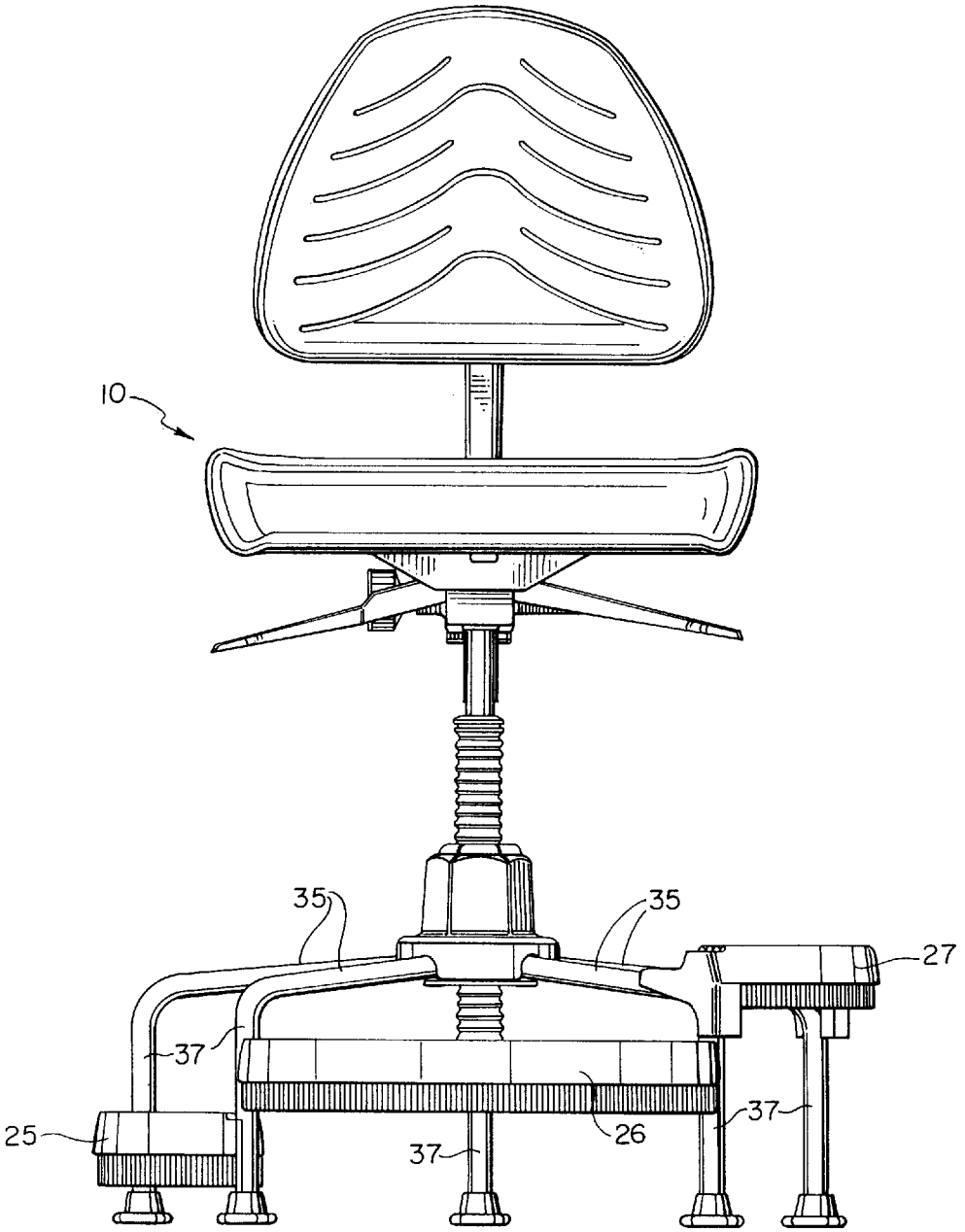
FIG. 5 is a front elevation view of the chair.
Figure 6:
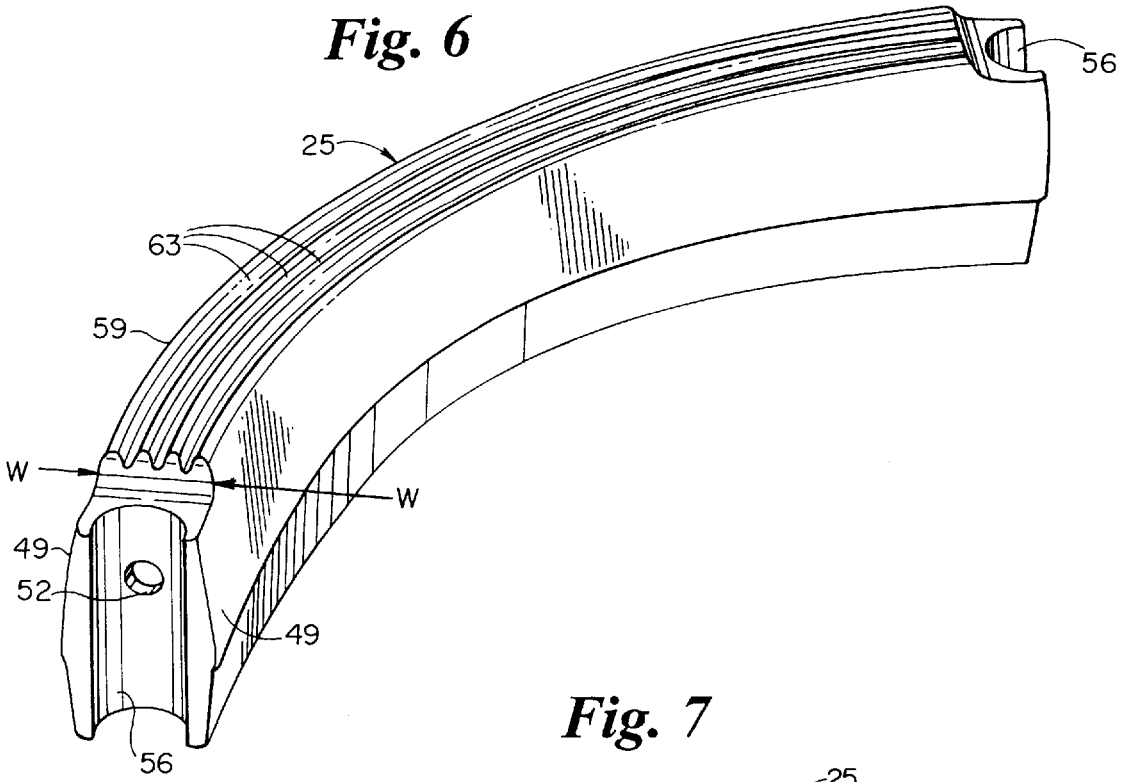
FIG. 6 is a perspective view of a first embodiment footrest.

FIGS. 4 and 5 depict, in side view, footrests 25 and 26. As shown, each of these footrests comprise means for attachment to vertical portion 37 of each supporting leg. FIG. 6 is a perspective view of footrest 25 showing an elongate outer wall structure 49 having a length generally corresponding to the length of the arc radius between adjacent chair legs 31 at vertical portions 37. Means 52 for attaching each footrest to various locations of legs 31 is shown in relation to end wall portion 56. In this embodiment, end wall portion 56 is shaped for conformal fit with part of a chair leg vertical portion 37. End wall portion 56 defines at least one aperture extending through the thickness of the wall, the aperture being sized for receipt of a locking assembly for locking the footrest to vertical portion 37 of legs 31. A locking assembly may comprise a locking bolt or pin, or it may comprise a more extensive assembly such as a locking bolt and nut, or other component(s) suitable for retaining the footrest against the legs 31 and fully capable of supporting the weight requirements standards appropriate to footrests. However, using the embodiments disclosed herein, it is possible to exceed minimal weight supporting standards by a substantial factor while still maintaining a relatively lightweight and durable chair 10.

Figure 7:
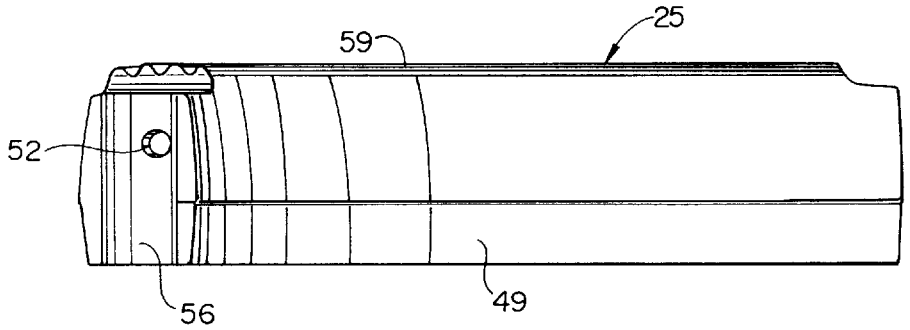
FIG. 7 is an inside radial view of a first embodiment footrest.
Figure 8:
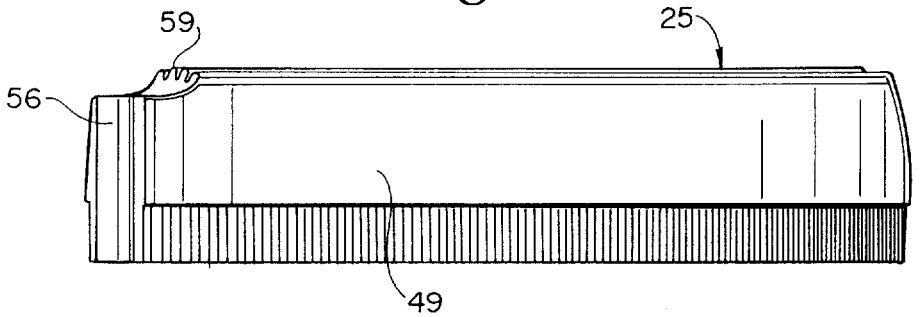
FIG. 8 is an outside radial view of a first embodiment footrest.
Figure 9:
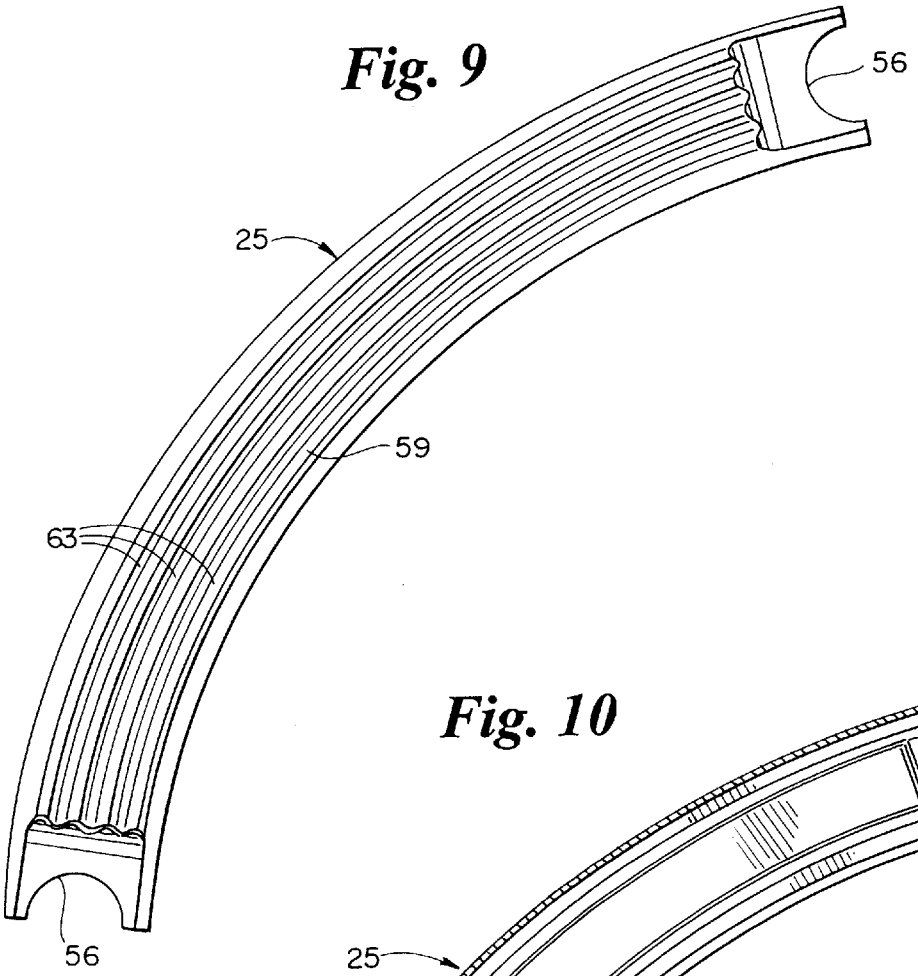
FIG. 9 is a top plan view of the first embodiment footrest.
Figure 10:
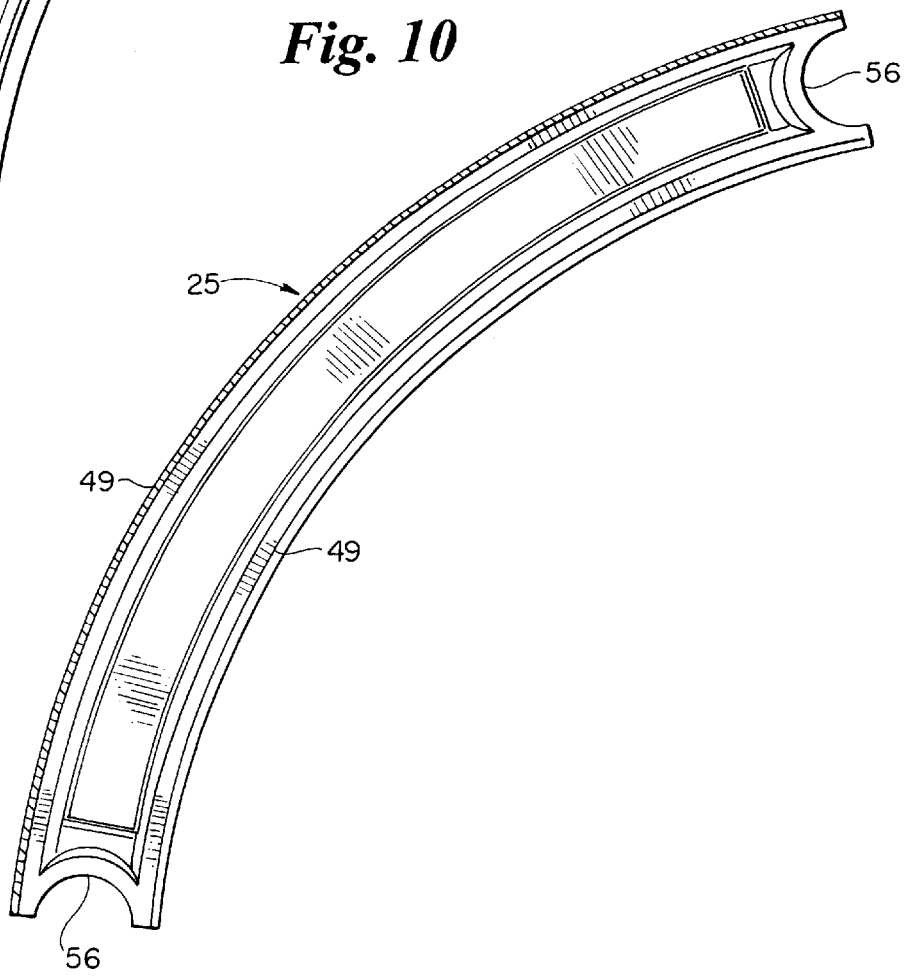
FIG. 10 is a bottom plan view of a first embodiment footrest.
Figure 11:
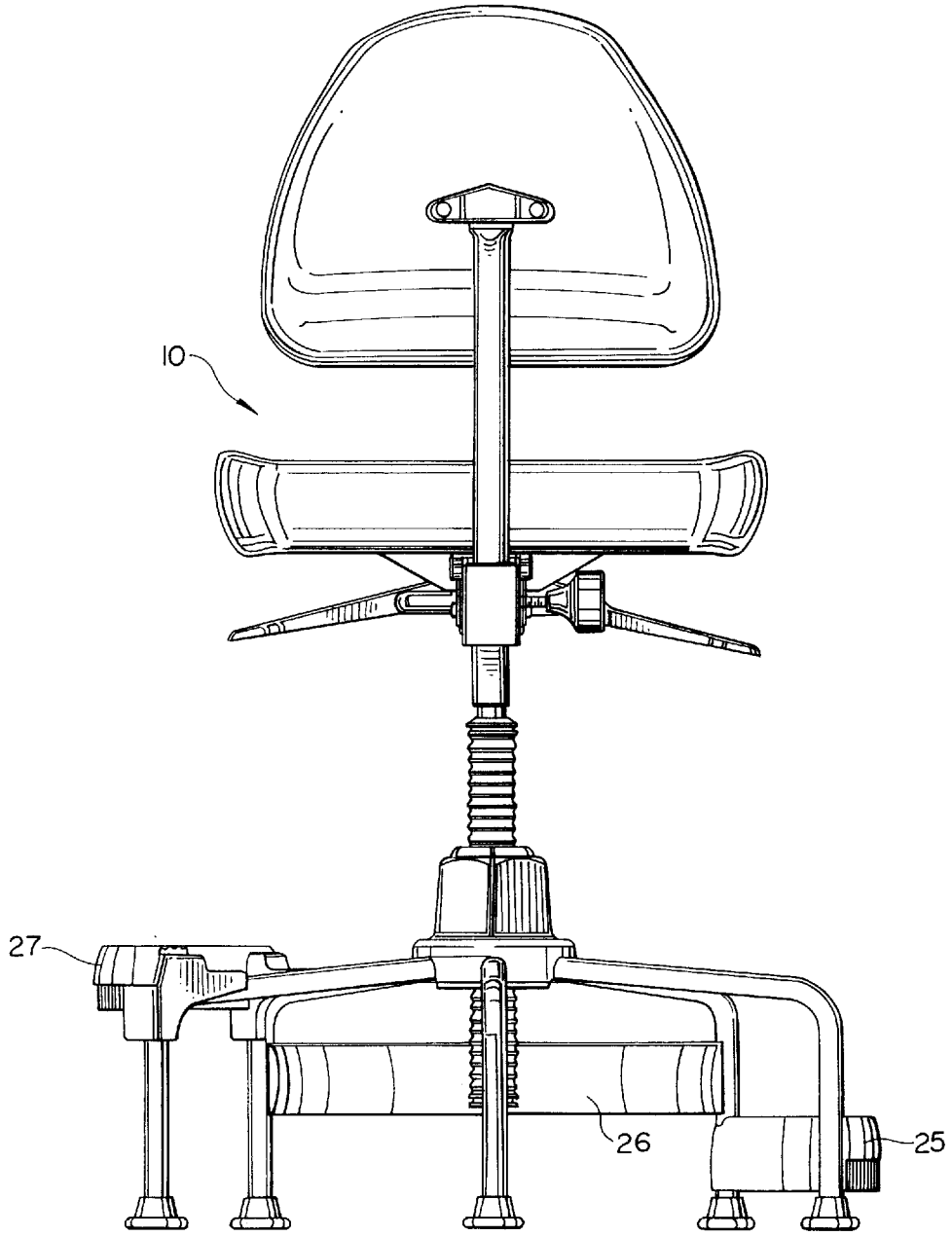
FIG. 11 is a side elevation view of a chair of the invention utilizing the inventive footrest configuration.
Figure 12:
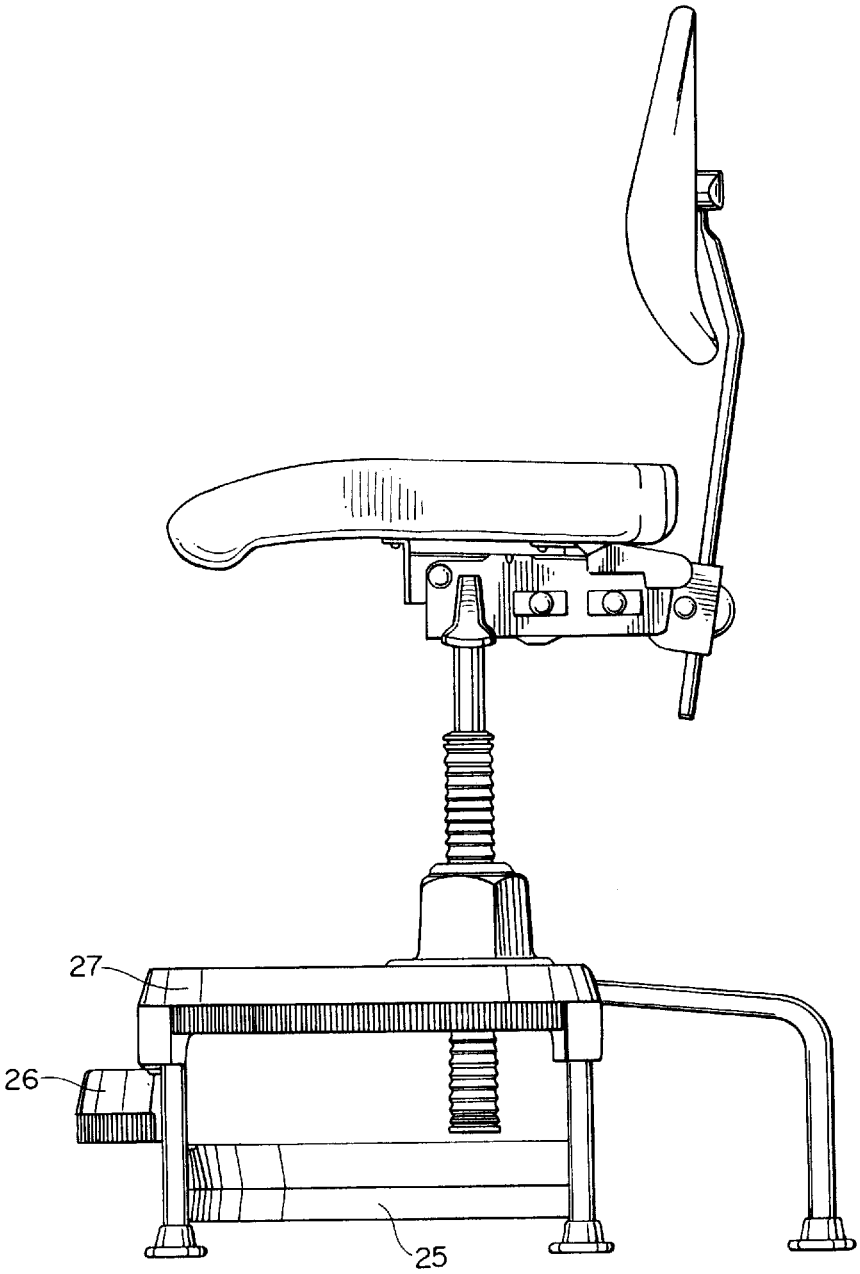
FIG. 12 is a side elevation view of the chair.
Figure 13:
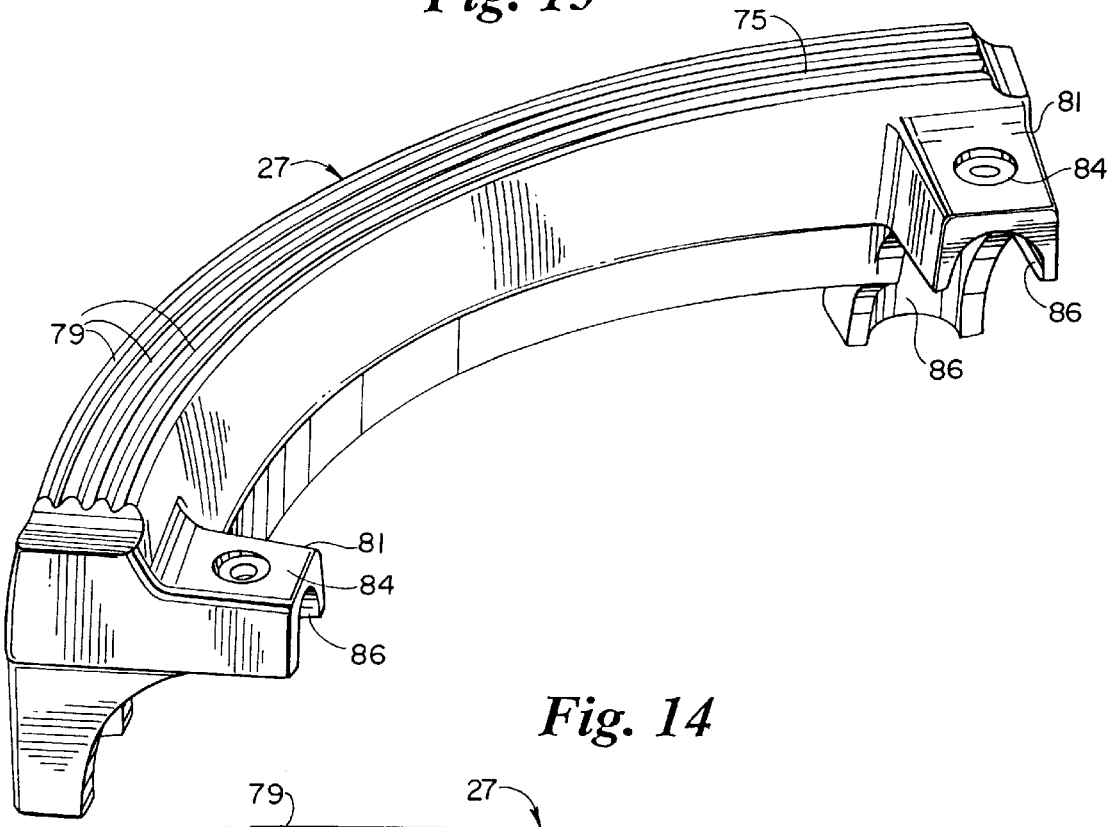
FIG. 13 is a perspective view of a second embodiment footrest.
Figure 14:
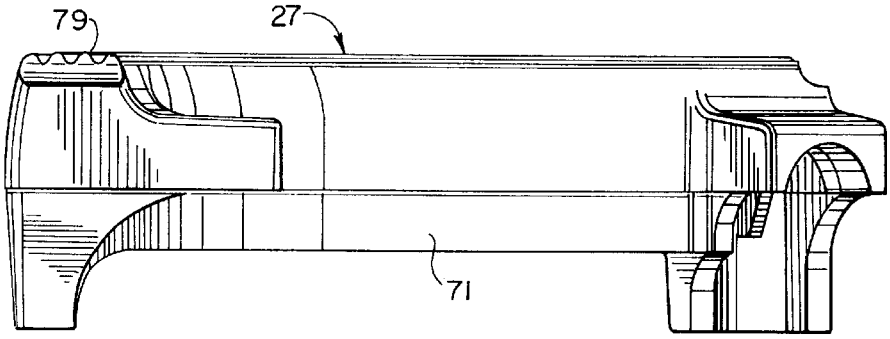
FIG. 14 is an inside radial view of a second embodiment footrest.
Figure 15:
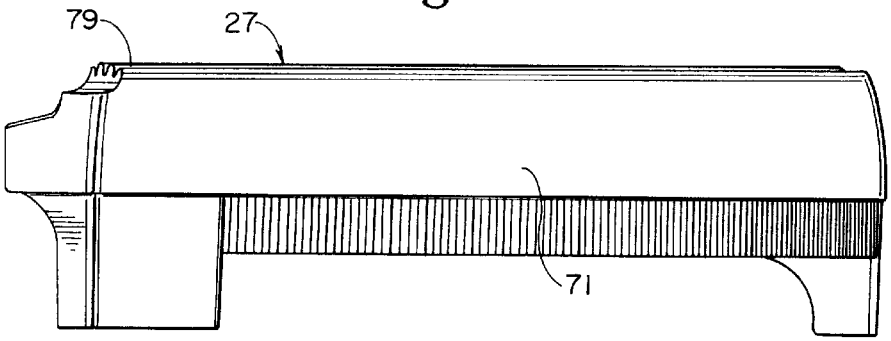
FIG. 15 is an outside radial view of a second embodiment footrest.
Figure 16:
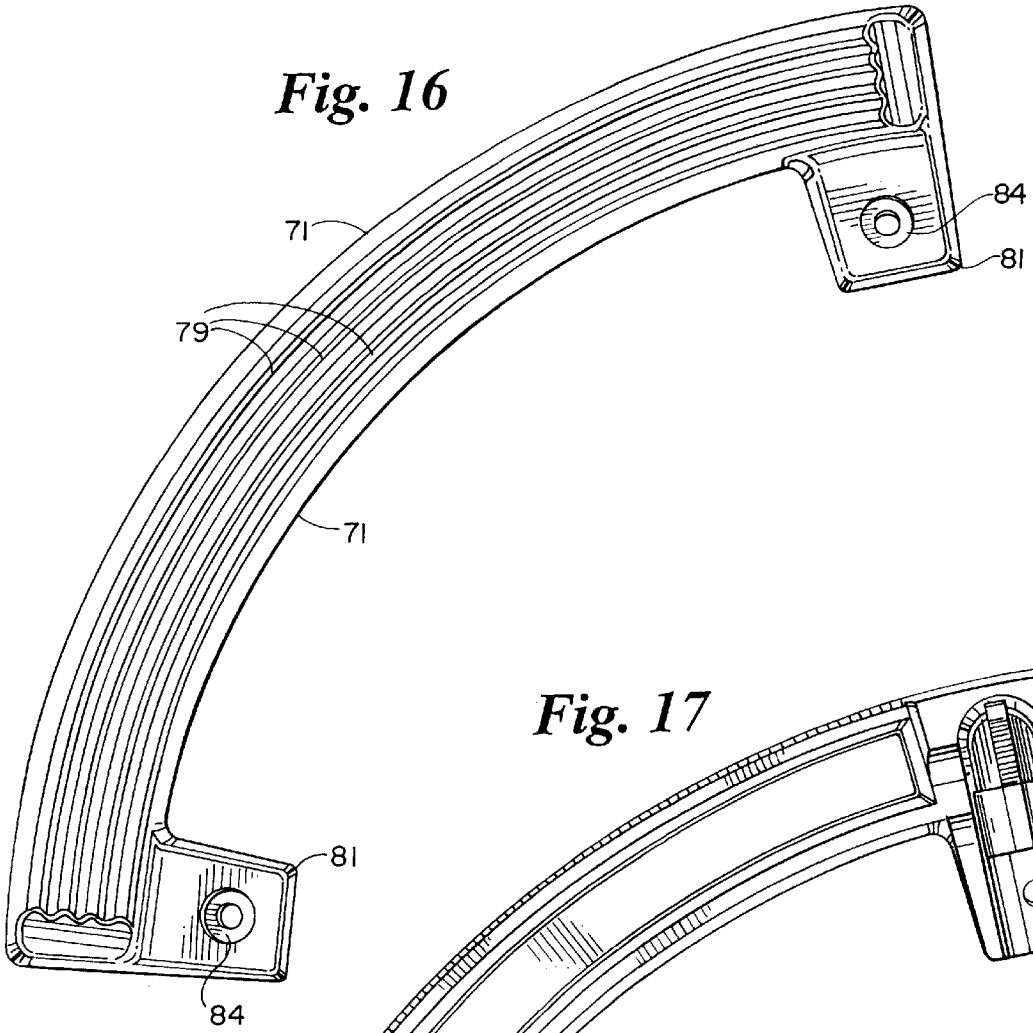
FIG. 16 is a top plan view of a second embodiment footrest.
Figure 17:
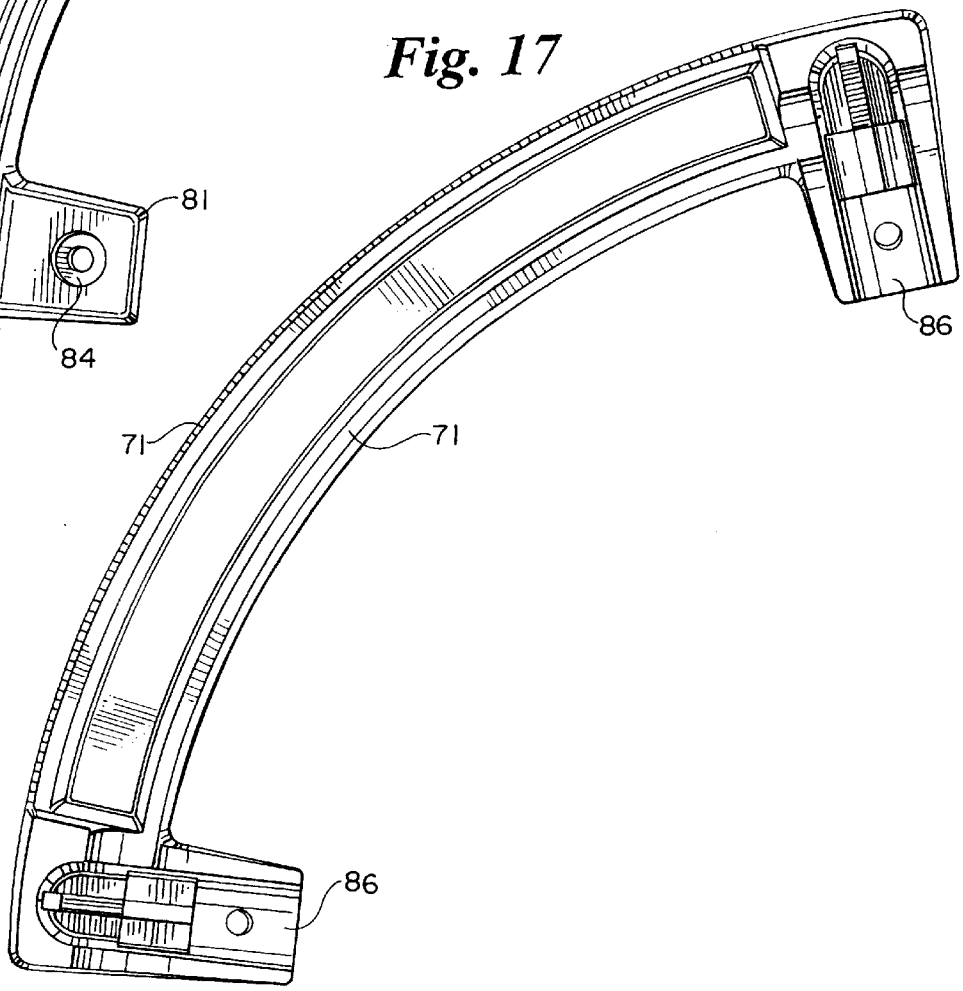
FIG. 17 is a bottom plan view of a second embodiment footrest.

FIGS. 7 and 8 are inside and outside radial views, respectively, of footrest 25, and FIGS. 9 and 10 are top and bottom views, respectively, of the same footrest. As seen in FIG. 10, this embodiment of footrest 25 is one of substantially hollow configuration with the exception of the above-mentioned outer wall structure, end wall portions, and upper surface. This low volume design further enhances the lightweight feature of chair 10, but also requires exceptional construction and design characteristics in order to achieve the weight supporting and durability requirements noted above. In one embodiment, footrest 25 is manufactured using a fiberglass filled, foam nylon material.

More particularly, a useful construction of materials suitable for footrest 25 further includes fiberglass filled foam nylon with nitrogen bubbles therein. Another excellent construction for footrest 25 includes glass filled thermoplastics, such as acrylonitrile-butadiene-styrene (ABS) and/or resins demonstrating suitable cost, strength, weight, and related characteristics.

A further enhancement of footrest 25 includes a plurality of ribs 63 shaped as upper surface 59 and extending between the arc radius length between end wall portions 56. Ribs 63 are designed to optimize the weight bearing characteristic of this footrest or bridge structure. Use of these lightweight yet strong materials and constructions also allows the width W-W of upper surface 59 to be several centimeters. This enhances comfort for the user's feet, and improves overall utility by providing increased surface contact area for a user.

Another embodiment of footrest suitable for use with chair 10 includes that shown in FIG. 1 as footrest 27. This footrest has similar characteristics to footrests 25 and 26, and is also shaped substantially as an arc curve, but has different mounting means enabling mounting of a footrest 27 on non-vertical surfaces such as surfaces 35 of chair legs 31. Referring to FIGS. 11–17, various views of footrest 27 are shown. An outer wall structure 71 forms durable structural support for top surface 75, shown in this embodiment with a plurality of strength reinforcing ribs 79.

This embodiment of footrest 27 is designed for attachment to chair legs 31 along the substantially horizontal portion 35. Therefore, rather than having footrest attachment means along an axially oriented surface, when chair 10 is viewed from a top or bottom perspective, such as end wall portions 56 in footrests 25, 26, different means are employed for the structure of footrest 27. Rather, footrest 27 comprises a radially oriented member 81 having a first surface 84 defining an aperture therethrough for receipt of means for attaching the footrest to the legs of the chair. A second surface 86 is shaped for conformal fit against a part of chair leg horizontal portion 35 and, optionally, a part of chair leg vertical portion 37. Second surface 86 also defines an aperture for receipt of attaching means. Preferably, footrest 27 is formed of the same materials and in the same manner as footrests 25 and 26.

The combination of features shown and described in relation to footrests 25, 26 and 27, provide exceptional utility in the design and operation of the base portion of chair 10. It is possible to configure chair legs 31 with a variety of apertures to accommodate attachment of the various footrests at different heights and locations along the legs. In the embodiment of chair 10 shown in FIG. 1, the lower footrests may be used as stairs to allow ease of positioning a user's body into the chair seating and backrest portion. Once in a seated position, the user may employ any of the footrests configured at different heights while comfortably performing duties required of the user. This footrest height variability, combined with exceptional stability of base portion 13, provides great advantage and comfort to the user of chair 10. Moreover, considerable utility is achieved using very high strength and lightweight footrest components, as configured, or in similar advantageous manners.

Figure 18:
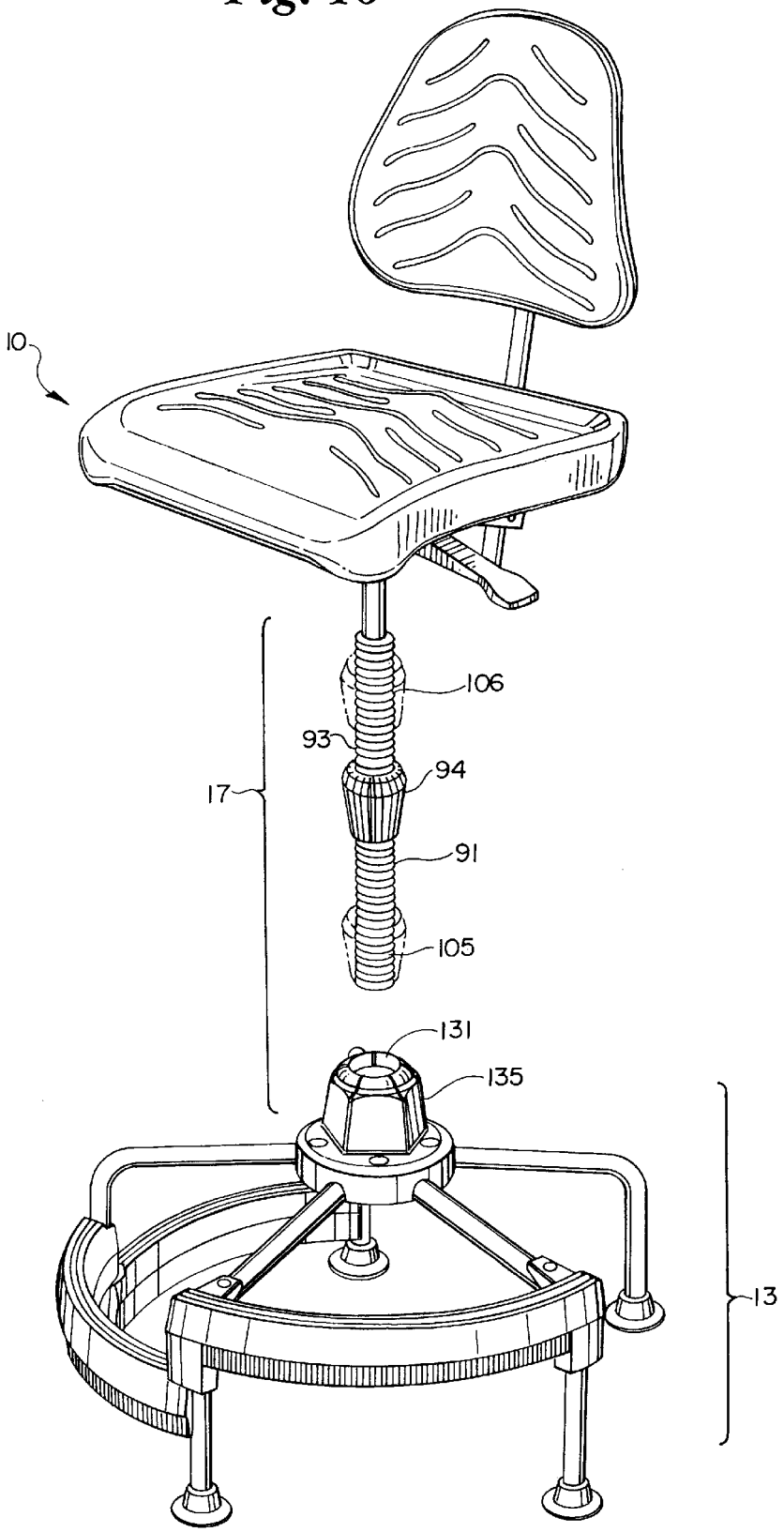
FIG. 18 is an exploded perspective view of a chair of the present invention illustrating the motion of the support column and tapered coupling relative to the base portion.

Referring again to FIG. 1, chair 10 also comprises height adjusting portion 17. This portion of chair 10 consists of several components shown best in the combination of FIGS. 18–23. FIG. 18 shows chair 10 with a weight bearing or support column 91 configured to support seating and backrest portion 21. Support column 91 is preferably constructed of lightweight but high strength material, such as a high strength metal or composite material. As shown in FIG. 18, 19 and 21–23, support column 91 comprises an exterior surface with engaging means 93 arranged along its length for selectively engaging portions of a coupling 94. In one embodiment, the support column engaging means comprises a plurality of radially oriented circumferential ridges 96. In another embodiment, support column engaging means 93 comprises a plurality of columnar portions arranged at different radii from a central axis of the support column.

Coupling 94 is designed for selectively engaging support column 91 and for positioning support column 91 relative to a fixed platform. In this use of support column 91 as part of a height adjustment portion of a chair, then the fixed platform is the chair base portion 13. It is recognized, however, that the novel constructions and use of the various components of height adjusting portion 17 may be employed with great advantage as part of a table or similar structure.

Figures 19, 20:
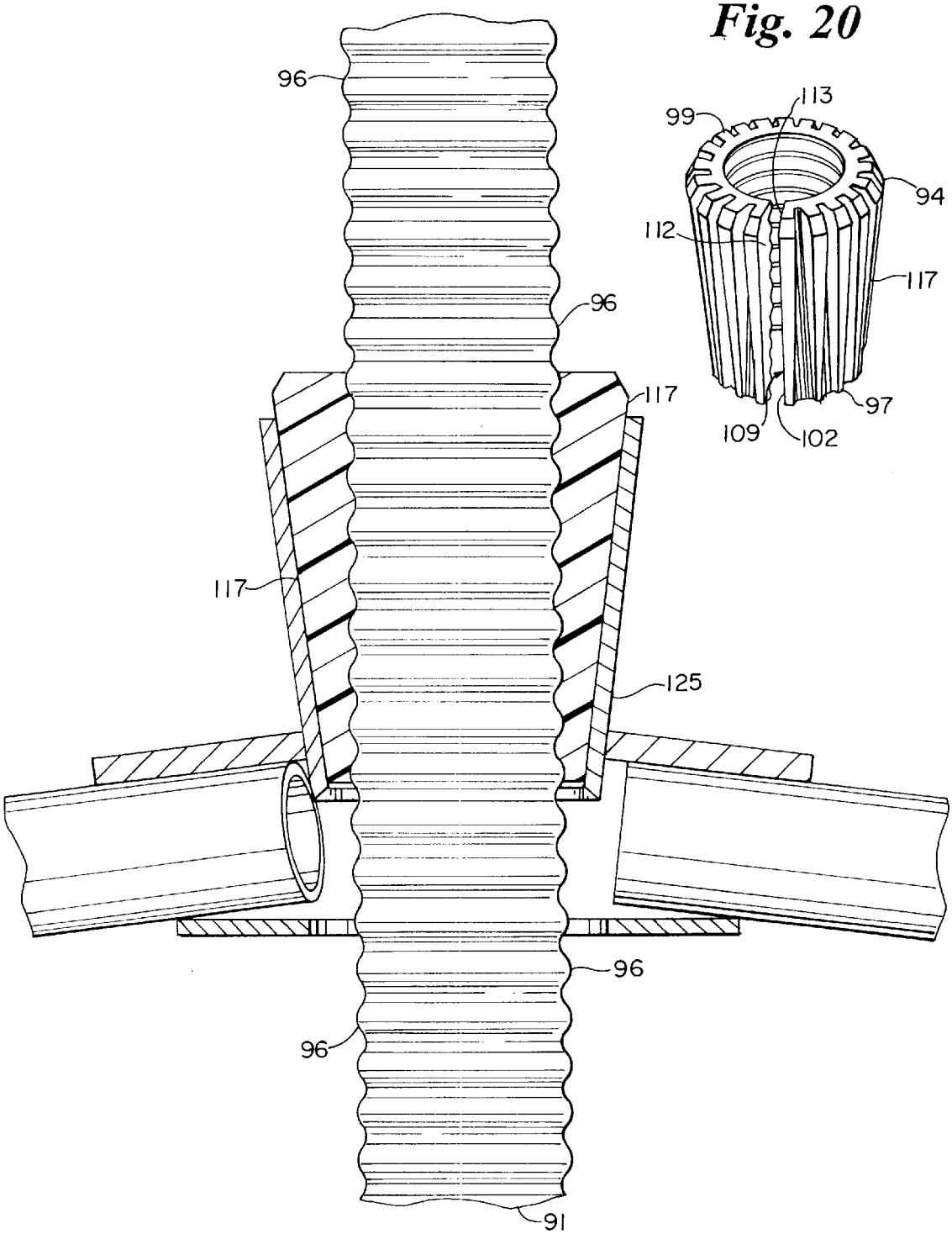
FIG. 19 is an enlarged view of a portion of the support column at the base of the chair.
FIG. 20 is a perspective view of a coupling suitable for use with the support column of the chair.

One embodiment of coupling 94 has a shape similar to a truncated cone with a base portion having a smaller radius than an opposing portion. As shown in FIG. 20, base portion 97 has a smaller radius than opposing portion 99. Opposing portion 99 is shaped for contact with an inner surface of a resilient collar attachment, as described below. One embodiment of the shape of opposing portion 99 includes a cambered surface. The coupling inner surface is shaped for contacting the support column engaging means in a substantially matched shape friction fit. Another important aspect of coupling 94 is its adjustable circumference means 102 which readily allows placement anywhere along the length of support column 91 where engaging means 93 is present. FIG. 18 shows examples of coupling 94 at alternate locations 105, 106 along support column 91. These locations along the support column determine the various different height settings that the chair seating and backrest portion would experience. The embodiment of adjustable circumference means 102 shown in FIG. 20 comprises a gap 109 in the coupling wall structure defined as wall portions 112, 113. This gap permits selective enlargement or reduction in the circumference of the coupling, thereby allowing either relative movement between the coupling and the support column or locking engagement with matched portions of the support column structure.

Coupling 94 has side portions 117 with an outer shape optimized for rapid and cost-efficient manufacturing of durable and resilient material. In the embodiment shown in FIG. 20, side portions 117 have a plurality of spaced radially oriented axially tapered segments designed for contact and retention by a retaining means configured as part of the fixed platform. In this example, FIG. 19 illustrates a suitable relationship between a tapered amber or retaining cup portion 125 of retaining means 127 and coupling side portions 117. The axially tapered segments of the coupling preferably have a taper from a vertical reference line R designed to substantially match the taper of other related components of the entire height adjustment portion, as further explained below. Generally, however, this range of taper is between about 4° and 10°, with a preferred taper for the chair embodiment as shown of between about 6° and 9°.

Figure 21:
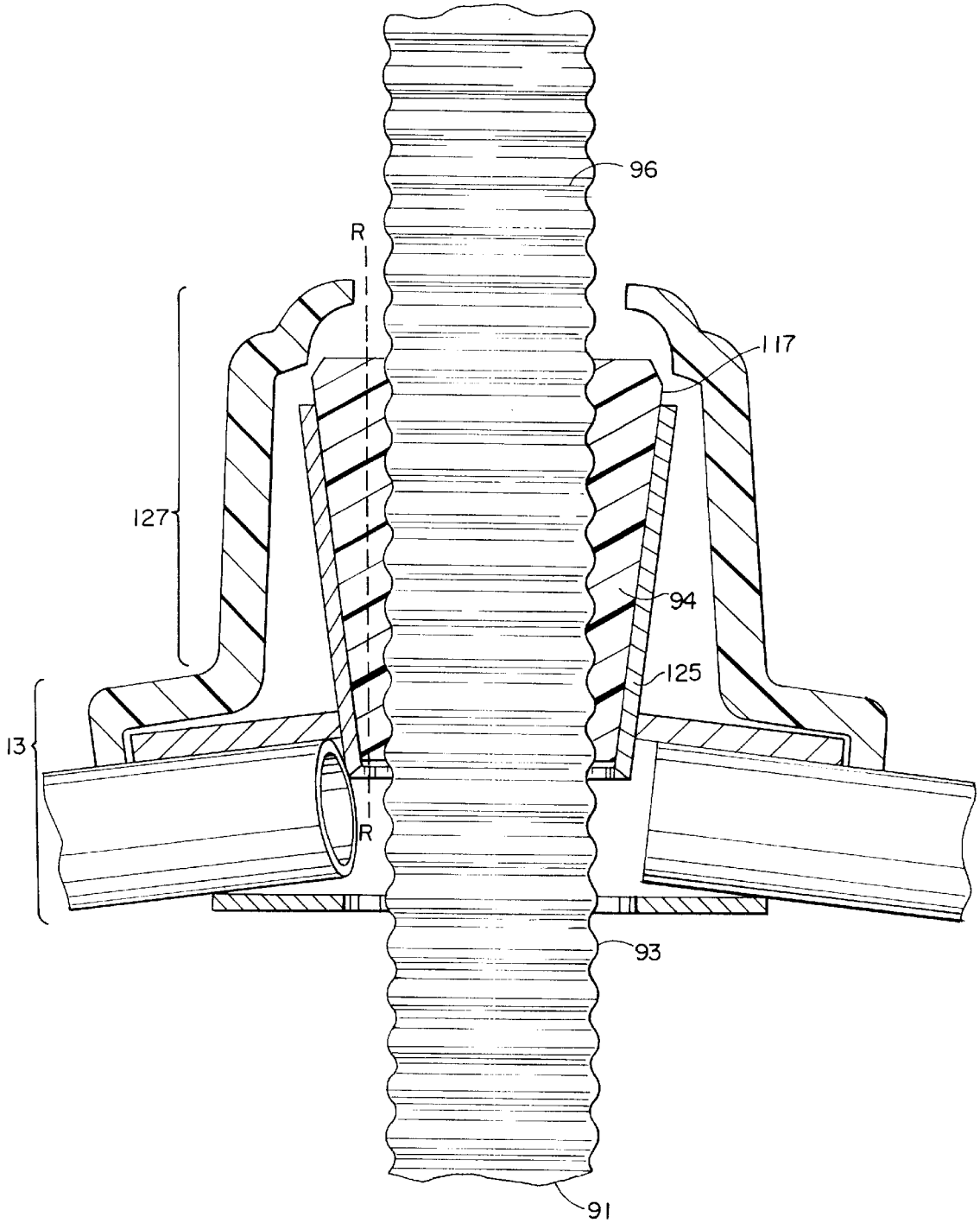
FIG. 21 is a schematic view of the support column and coupling in a first configuration.
Figure 22:
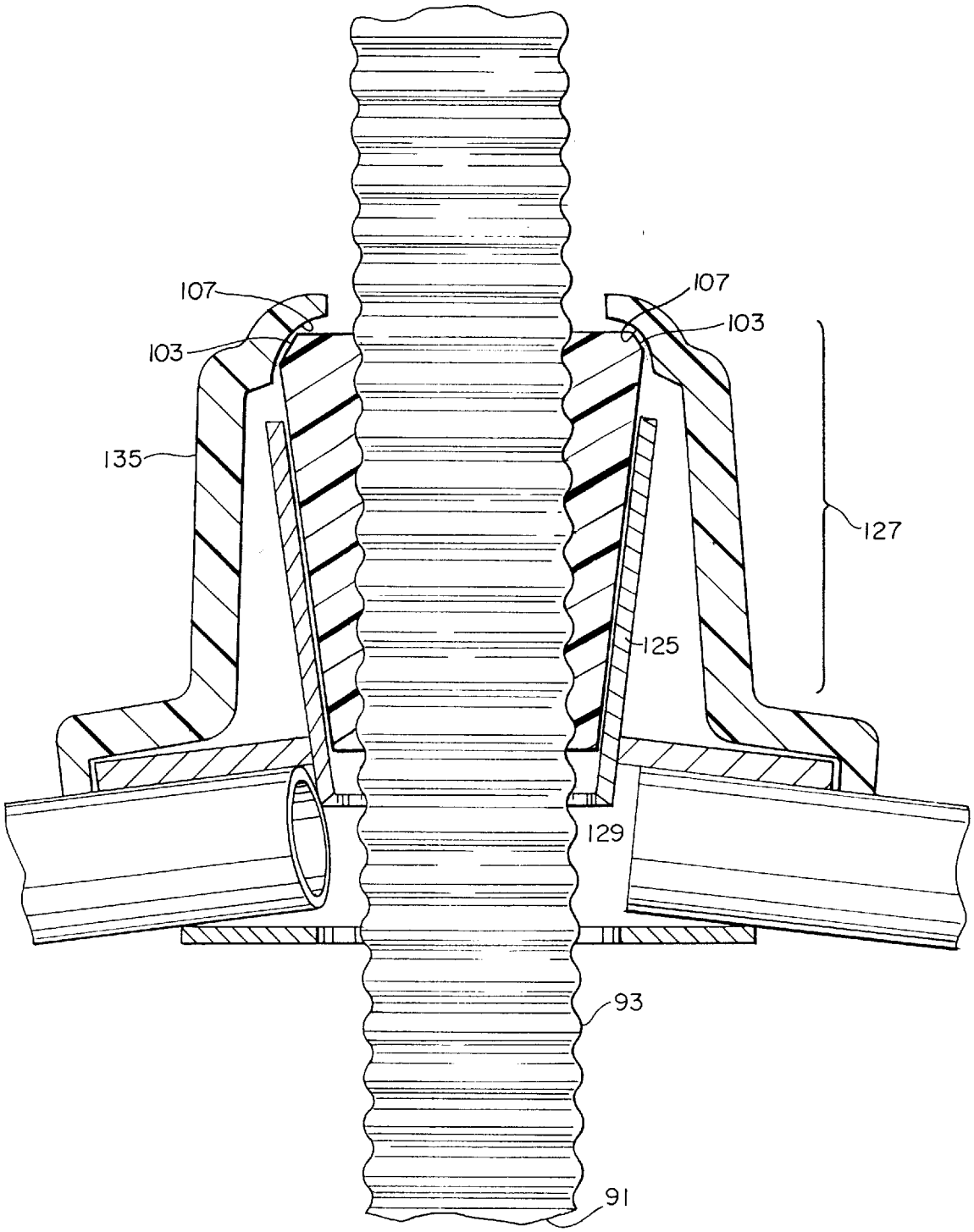
FIG. 22 is a schematic view of the support column and coupling in a second configuration.
Figure 23:
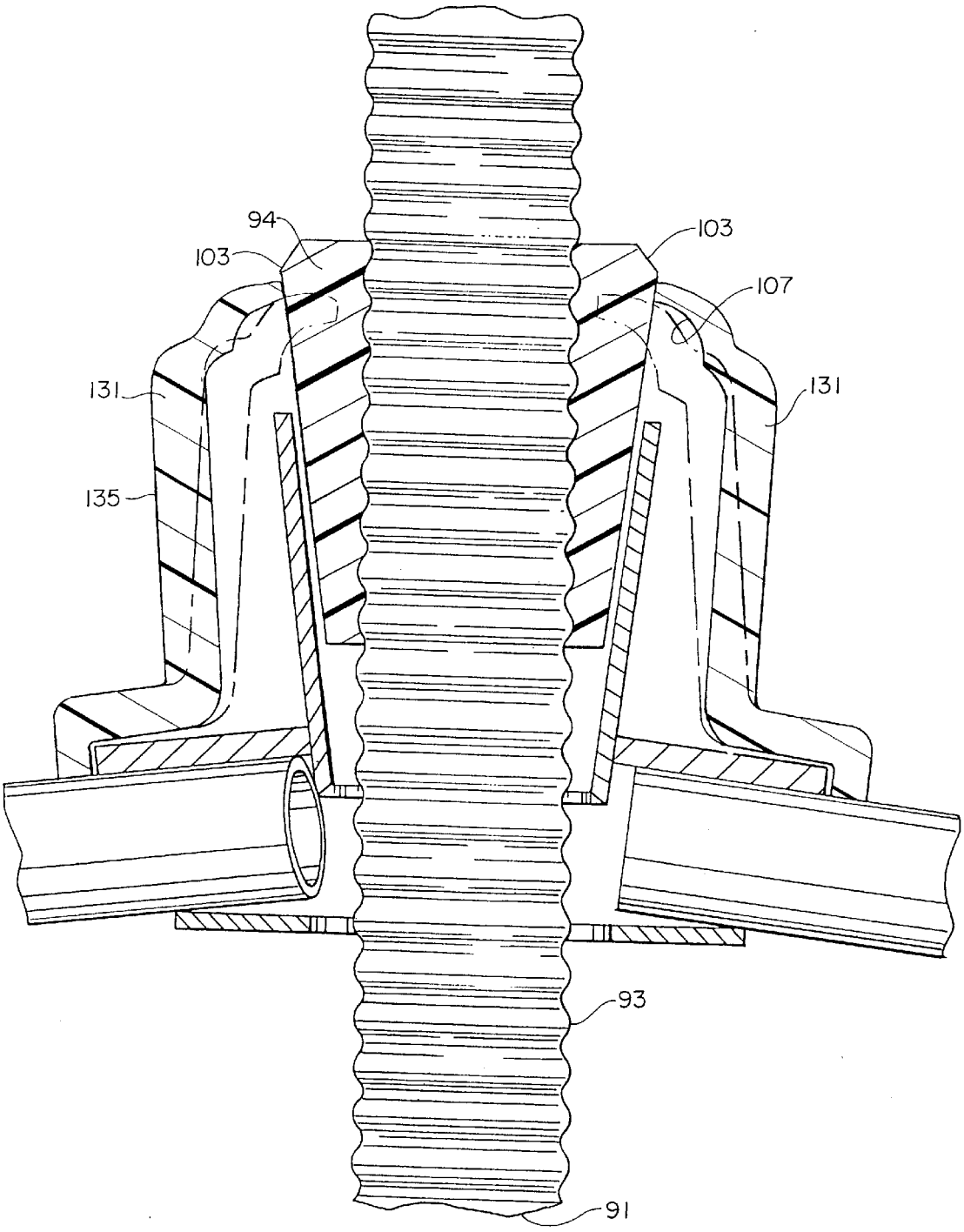
FIG. 23 is a schematic view of the support column and coupling in a third configuration.

Chair 10 is readily adjustable for different sized users, and is also easily moved between different positions and locations. For example, referring to FIGS. 18 and 21–23, chair 10 is shown with support column 91 and coupling 94 in various positions relative to base portion 13. In FIG. 21, the support column 91 and coupling 94 are shown positioned at rest within retaining means 125. In this position a user may sit on the chair. FIG. 22 depicts support column 91 and coupling 94 in an initial position of being lifted by a user away from a resting position in contact with base portion 129 of retaining cup 125. This may result from a user desiring to remove and adjust the coupling along the axis of the support column 91, thereby adjusting the height of the seating and backrest portion. This removal sequence is further depicted in FIG. 23. Here the support column has been moved vertically away from contact with retaining cup portion 125. This movement is matched by coupling 94, which in turn contacts resilient retaining members 131 of collar 135. As coupling 94 moves vertically, cambered surface 103 contacts an inner surface 107 of retaining members 131. If the vertical movement of support column 91 and coupling 94 has a first force $F_1$, at the point where cambered surface 103 contacts inner surface 107, and force $F_1$ is less than a force $F_2$ necessary to move resilient retaining members away from support column 91, then retaining members 131 will retain coupling 94 within the collar 135. This will allow the user, by vertically lifting the seating and backrest portion 21, to lift and move the entire chair including the base portion 13. However, referring to FIG. 23, if lifting force $F_1$ is greater than force $F_2$ at the point of contact between the coupling cambered surface 103 and inner surface 107 of retaining members 131, then the shape of coupling 94 will urge movement of retaining members 131 away from support column 91. This will allow coupling 94 to be removed from collar 135 while the chair base portion 13 remains in place. This is shown, for example, in FIG. 18. In other words, the release and carrying mechanism of chair 10 accommodates different lifting forces with different results. For example, this requires an absolute value for the ratio of the second force ($F_2$) required to remove the coupling from within the collar attachment to the force ($F_1$) created by the overall weight of the chair base portion in static contact with the coupling to be greater than about 1:1. It is also recognized that the radius of the coupling base portion 97 permits ease of insertion of the coupling back into the collar, as desired.

Figure 24:
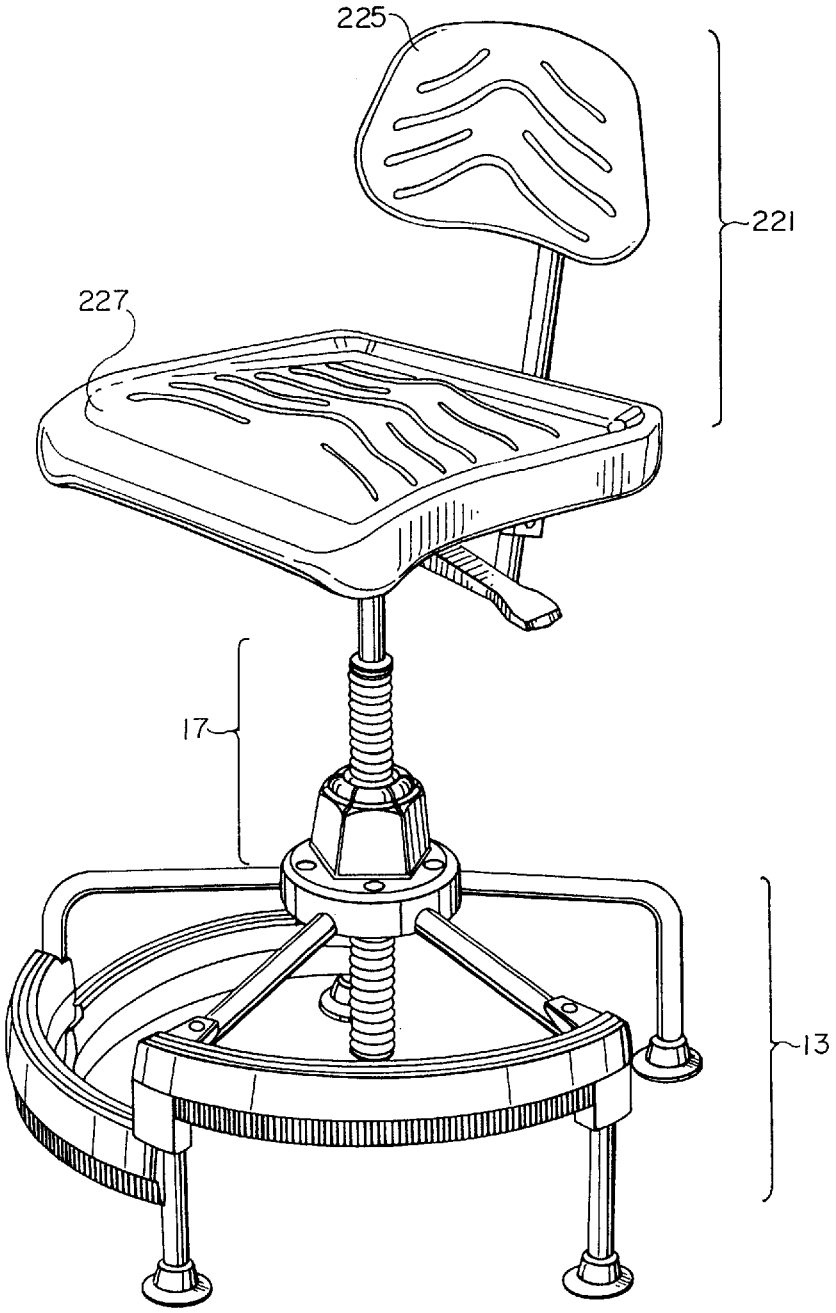
FIG. 24 is a perspective view of the chair utilizing a second embodiment back rest.

FIG. 24 is a perspective view of chair 10 having a seating and backrest portion 221 that utilizes a second embodiment backrest 225 that is smaller than the backrest shown in the embodiment of chair 10 in FIG. 1. In combination with the various contoured and peripheral support features of the seat 227, backrest 225 provides improved comfort for certain users. Chair 10 has numerous features and structures which optimize its desirability for all kinds of users. In addition to the adjustable mechanisms normally associated with chairs of this general type, the novel footrest and lift or release mechanisms greatly improve the ergonomic aspects of this important workplace structure. Although certain embodiments and features of improved chair 10 have been shown, such features are not intended to overly limit the scope of the invention claimed below.

What is claimed is:

1. A mechanism for adjusting the position of a support column in relation to a fixed platform, comprising:

a) a support column having an exterior surface with a plurality of engaging means arranged along the length of the column for selectively engaging portions of a coupling;

b) a coupling shaped for selectively engaging the support column and positioning the support column relative to a fixed platform, the coupling having an inner surface shaped for contacting the support column engaging means in a substantially matched shape friction fit, the coupling further having adjustable circumference means for permitting selection between locking engagement and relative movement between the support column and the coupling;

c) retaining means for operably retaining the coupling in fixed relation to the support column; and d) a fixed platform attached to the retaining means.

2. The mechanism of claim 1 in which the coupling comprises an external tapered surface.

3. The coupling of claim 2, further comprising a base portion and an opposing portion, the base portion with a base portion radius and the opposing portion with an opposing portion radius, the base portion radius smaller than the opposing portion radius.

4. The mechanism of claim 1 in which the support column supports a seat of a chair and the fixed platform is the base of the chair.

5. The mechanism of claim 1 in which the support column supports a surface of a table and the fixed platform is part of the table support.

6. The mechanism of claim 1 in which the support column engaging means comprises a plurality of columnar portions arranged at different radii from a central axis of the support column.

7. The mechanism of claim 1 in which the support column engaging means comprises a plurality of radially oriented circumferential ridges.

8. The coupling of claim 2 in which the external tapered surface comprises a plurality of spaced radially oriented axially tapered members designed for contact and selective retention by the retaining means.

9. The coupling of claim 2 in which a range of taper of the external tapered surface is between 4° and 10° from the vertical.

10. The coupling of claim 2 in which a range of taper of the external tapered surface is between 6.5° and 8.5°.

11. The mechanism of claim 1 in which the retaining means comprises a tapered amber which is sized for receipt of the tapered coupling in a sliding internal fit.

12. The mechanism of claim 1 in which the retaining means further comprises an external collar sized for selective contact with and enclosure of the coupling according to whether the user desires locking engagement of the coupling within the collar or removal of the coupling from within the collar.

13. The mechanism of claim 4 further comprising footrests attached to the fixed platform.

14. The mechanism of claim 13 in which the footrests are useful as stairs and are attached to the fixed platform at different heights.

15. A release and carrying mechanism for a chair having at least one vertical support column for a chair seat and a base against which the support column contacts, comprising:

a) a collar attachment for connection to the base, the collar attachment having a first portion for attachment to the base and an internally cambered resilient second portion for selective contact with a support column coupling; and b) a support column tapered coupling extending radially from the support column, the coupling comprising a base portion with an opposing cambered portion designed for contact with the collar attachment second portion during release and carrying of the chair;

c) the camber of the cambered second portion of the collar attachment substantially matching the camber of the cambered portion of the coupling so that when the coupling is surrounded by the collar attachment then a first force may be applied to move the coupling and cause static contact between the cambered portions of the coupling and the collar attachment without removing the coupling from within the collar and alternately a second force greater than the first force may be applied to move the coupling relative to the collar so that the cambered portions are in dynamic contact and the coupling is then removed from within the collar.

16. The release and carrying mechanism of claim 15 in which the coupling is in the shape of a truncated cone with a base portion having a smaller radius than an opposing cambered portion.

17. The release and carrying mechanism of claim 15 in which the absolute value of the ratio of the second force required to remove the coupling from within the collar attachment to the force created by the overall weight of the chair base portion in static contact with the coupling is greater than about 1:1.

18. A combination support step and footrest for a chair having a base with a plurality of angled base supporting members, comprising:

a) an elongate outer wall structure having a length generally corresponding to the distance between adjacent angled base supporting members of the chair base and reinforcing means for providing increased strength;

b) a pair of end wall portions having surfaces shaped for conformal attachment to outer surfaces of adjacent angled base supporting members; and c) means for attaching each combination support step and footrest to various locations of any of the angled base supporting members.

19. The combination support step and footrest of claim 18 in which the reinforcing means comprises horizontal ribs located along a top wall portion.

20. The combination support step and footrest of claim 18 in which a portion of the wall structure is manufactured of a material using fiberglass filled foam nylon with nitrogen bubbles.

* * * * *